US010487538B2

(12) United States Patent
Bentheimer et al.

(10) Patent No.: US 10,487,538 B2
(45) Date of Patent: Nov. 26, 2019

(54) DOOR ARRANGEMENT HAVING A MOTOR-DRIVEN LOCKING DEVICE

(71) Applicant: Gretsch-Unitas GmbH Baubeschlaege, Ditzingen (DE)

(72) Inventors: Hans Bentheimer, Ditzingen (DE); Daniel Gruendler, Sindelfingen (DE); Wolfgang Uebele, Aspach (DE); Zoltan Bencsik, Ditzingen (DE); Georg Bonn, Schwarzenbruck (DE)

(73) Assignee: GRETSCH-UNITAS GMBH BAUBESCHLAEGE, Ditzingen (DE)

( * ) Notice: Subject to any disclaimer, the term of this patent is extended or adjusted under 35 U.S.C. 154(b) by 550 days.

(21) Appl. No.: 15/126,300

(22) PCT Filed: Mar. 13, 2015

(86) PCT No.: PCT/EP2015/055350
§ 371 (c)(1),
(2) Date: Sep. 15, 2016

(87) PCT Pub. No.: WO2015/140078
PCT Pub. Date: Sep. 24, 2015

(65) Prior Publication Data

US 2017/0089097 A1 Mar. 30, 2017

(30) Foreign Application Priority Data

Mar. 18, 2014 (DE) ..... 20 2014 002 413 U

(51) Int. Cl.
*E05B 17/00* (2006.01)
*E05B 47/00* (2006.01)
(Continued)

(52) U.S. Cl.
CPC ..... *E05B 17/0029* (2013.01); *E05B 17/0033* (2013.01); *E05B 47/0012* (2013.01);
(Continued)

(58) Field of Classification Search
CPC ..... Y10T 292/096; Y10T 292/1021; Y10T 70/7062; Y10T 70/7028; E05B 17/22;
(Continued)

(56) References Cited

U.S. PATENT DOCUMENTS 5,394,718 A * 3/1995 Hotzl ..... E05B 47/0012 292/144
8,686,869 B2 * 4/2014 Sharma ..... G01B 7/31 292/251.5
(Continued)

FOREIGN PATENT DOCUMENTS

DE 3915569 A1 11/1990
DE 29906380 U1 6/1999
(Continued)

*Primary Examiner* — Mark A Williams
(74) *Attorney, Agent, or Firm* — Leydig, Voit & Mayer, Ltd.

(57) ABSTRACT

A door arrangement includes a door leaf movable relative to a frame. A locking device in a locked state locks the door leaf to the frame by at least one locking element and in an unlocked state releases the door leaf relative to the frame. An actuating element selects the state of the locking device. To transmit a movement of the actuating element, the locking device has a connecting bar which is arranged displaceably on the door leaf, wherein a motor-operated drive unit for driving the connecting bar is provided. A sensor device for the contactless detection of a movement of the connecting bar is provided and the motor-operated drive unit can be activated in accordance with a movement of the connecting bar detected by the sensor device.

20 Claims, 4 Drawing Sheets

(51) Int. Cl.
*E05B 47/02* (2006.01)
*E05C 9/02* (2006.01)
*E05C 9/18* (2006.01)

(52) U.S. Cl.
CPC ..... *E05B 47/026* (2013.01); *E05C 9/02* (2013.01); *E05C 9/1841* (2013.01); *E05B 2047/0069* (2013.01); *E05B 2047/0075* (2013.01); *E05B 2047/0091* (2013.01)

(58) Field of Classification Search
CPC ..... E05B 2047/0067; E05B 47/0012; E05B 65/108; E05B 2047/0094; E05B 2047/0059; E05B 47/0001; E05B 17/0029; E05B 2045/065; E05B 2045/0695; E05B 2047/0091
See application file for complete search history.

(56) References Cited

U.S. PATENT DOCUMENTS

2007/0214848 A1* 9/2007 Meyerle ..... E05B 47/0011 70/278.2
2009/0193859 A1* 8/2009 Kwon ..... E05B 47/026 70/91
2011/0254658 A1* 10/2011 Hui ..... E05B 7/00 340/5.2
2014/0165673 A1* 6/2014 Tyner ..... E05B 17/00 70/141
2014/0361552 A1* 12/2014 Hartford ..... E05C 1/14 292/163
2015/0308155 A1* 10/2015 Eller ..... E05B 47/0012 292/143
2016/0108650 A1* 4/2016 Hagemeyer ..... E05B 65/0858 292/25
2016/0130840 A1* 5/2016 Garneau ..... E05B 47/0012 292/201
2016/0145904 A1* 5/2016 Lowder ..... E05B 63/08 340/542
2018/0340354 A1* 11/2018 Beck ..... E05B 63/04

FOREIGN PATENT DOCUMENTS

DE 20203565 U1 5/2002
DE 10139675 A1 2/2003
DE 20312385 U1 10/2003
DE 102006000045 A1 8/2007
DE 102009027760 A1 1/2011
DE 202012007916 U1 10/2012
DE 102012203593 A1 9/2013
EP 0564441 A1 10/1993
EP 0743410 A2 11/1996
EP 1283318 A1 2/2003
EP 1464783 A2 10/2004
EP 2642050 A2 9/2013

* cited by examiner

DOOR ARRANGEMENT HAVING A MOTOR-DRIVEN LOCKING DEVICE

CROSS-REFERENCE TO PRIOR APPLICATIONS

This application is a U.S. National Phase Application under 35 U.S.C. § 371 of International Application No. PCT/EP2015/055350, filed on Mar. 13, 2015, and claims benefit to Utility Model Application No. DE 20 2014 002 413.8, filed on Mar. 18, 2014. The International Application was published in German on Sep. 24, 2015 as WO 2015/140078 under PCT Article 21(2).

FIELD

The invention relates to a door arrangement, in particular a house or balcony door arrangement, comprising a door leaf which can be moved relative to a frame, having a locking device which in a locked state locks the door leaf to the frame by at least one locking element, and which in an unlocked state releases the door leaf relative to the frame, wherein an actuating element which can be actuated mechanically by an operator is provided to select the state of the locking device, and wherein, in order to transmit a movement of the actuating element to the at least one locking element, the locking device has a traction rod or driving rod which is arranged displaceably on the door leaf, wherein a motor-driven drive unit for driving the traction rod or driving rod is provided.

BACKGROUND

A door arrangement of this type has become known under the name "GU-SECURY Automatic mit A-Öffner" ["GU-SECURY Automatic with A-Opener"] by the applicant Gretsch-Unitas GmbH Baubeschläge, Johann-Maus-Straße 3, 71254 Ditzingen. The already-known door arrangement has the advantage that the motor-driven drive unit provides an additional possible way of driving the traction rod or driving rod, so that a locking state of the locking device can be changed independently of an actuating state of the actuating element (for example a follower or a closing cylinder). In this manner, remote control of the locking device can be realized, for example in order to unlock the street door of an apartment building by a control unit provided in the apartment.

It is an object of the invention to further improve the operating comfort of the already-known door arrangement.

SUMMARY

This object is achieved according to the invention in that a sensor device for the contactless detection of a movement of the traction rod or driving rod is provided and in that the motor-driven drive unit can be activated dependent on a movement of the traction rod or driving rod detected by the sensor device.

In the context of the invention, it has been recognized that in unfavorable conditions it may happen that operation of the actuating element independent of the motor-driven drive unit is accompanied by increased operating forces. According to the invention, it has furthermore been recognized that the traction rod or driving rod is moved upon actuation of the actuating element and that this movement can be detected. The detection of the movement of the traction rod or driving rod takes place in contactless manner, so that the detection of movement as such does not itself contribute to increasing the operating forces necessary for operation of the actuating element. Furthermore, it has been recognized according to the invention that the operating forces for displacing the traction rod or driving rod upon an initial movement of the traction rod or driving rod out of an idle position are still comparatively low, at any rate as long as such a movement of the traction rod or driving rod is not yet effective for changing the locking state of the at least one locking element. Finally, it has been recognized according to the invention that a further movement, succeeding the initial movement, of the traction rod or driving rod can take place in that the drive device already present (for example for the purpose of remote control) is activated and thus the subsequent movement of the traction rod or driving rod which is effective for changing the locking state of the at least one locking element is brought about by the motor-driven drive. This motor-driven driving of the traction rod or driving rod can take place in particular independently of an actuating state of the actuating element, so that a change in the locking state of the at least one locking element takes place exclusively by the action of the motor-driven drive and without operating forces having to be exerted on the operating element.

Overall, a very comfortably operable door arrangement is provided which is suitable in particular also for stiff locking devices.

In a preferred embodiment of the invention, provision is made for a first part of the sensor device to be formed by a portion of the traction rod or driving rod and for a second part of the sensor device to be arranged fixed to the door leaf. This has the advantage that movement of the traction rod or driving rod can be detected directly without the traction rod or driving rod having to be changed or converted by an additional sensor part. This is advantageous in particular with regard to the fact that already-known systems referred to first hereinbefore can be retrofitted in a simple manner.

The portion of the traction rod or driving rod which forms the first part of the sensor device is preferably a material recess or material cutout in the traction rod or driving rod, in particular in the form of an elongate hole pocket or elongate hole aperture. Such material recesses or material cutouts are provided in already-known and conventional traction rods or driving rods in order to screw the lock in the door leaf and nevertheless to permit free movement of the traction rod or driving rod between the faceplate and door leaf. Advantageously, elongate hole pockets or elongate hole apertures can therefore be used without any modification of the already-known traction rods or driving rods being necessary. This too provides a particularly simple possibility of retrofitting for already-known systems referred to first hereinbefore.

A more preferred embodiment of the invention provides for the second part of the sensor device to be in the form of a coil for generating a magnetic field which is changeable dependent on the position of the traction rod or driving rod. A coil of this type permits the use of a non modified traction rod or driving rod described above. As a result, a contactless sensor device can be provided which furthermore is not susceptible to disruption, for example due to dirt.

Additionally or alternatively to the use of a coil, the second part of the sensor device is in the form of an optical sensor.

Further, it is advantageous if the second part of the sensor device and the motor-driven drive are arranged in a common housing.

This has the advantage that the motor-driven drive of an already-known system referred to first hereinbefore can be exchanged in a simple manner, without additional installation space having to be provided for the second part of the sensor device. This too makes simple retrofitting possible.

The invention is advantageous in particular when the locking device comprises a plurality of locking elements which cooperate with the traction rod or driving rod. Such locking devices provide a greater degree of security against break-ins in particular for external doors of buildings; the use of a plurality of locking elements is however accompanied by an increase in the operating force necessary for the actuation of the locking elements as a whole. Therefore it is particularly advantageous for a plurality of locking elements if the motor-driven drive unit, once an initial movement of the traction rod or driving rod has been detected, brings about the further, subsequent movement of the traction rod or driving rod and thus drives the locking elements independently of the actuating element which can be actuated by the operator.

The activation of the motor-driven drive unit dependent on a movement of the traction rod or driving rod which is detected by the sensor device preferably takes place for the purpose of transferring the locking device out of the locked state into the unlocked state, in particular exclusively for the purpose of transferring the locking device out of the locked state into the unlocked state, and not for the purpose of transferring the locking device out of the unlocked state into the locked state. This has the advantage that a possibility of unlocking the locking device which is desired for safety reasons can be triggered by initial low operating forces on the actuating element. This is advantageous in particular when the operator is a child or a frail person.

In the event that the motor-driven drive unit does not serve to transfer the locking device out of the unlocked state into the locked state, it is preferred for the motor-driven drive unit to transfer the traction rod or driving rod by a pressure force transmission unit in an opening direction out of the locked state into the unlocked state, and for the motor-driven drive unit to be uncoupled from the traction rod or driving rod in a closing direction which is opposed to the opening direction. In this manner, it is possible for unlocking of the locking device to take place by the motor-driven drive unit, but in the event of a power failure and failure of the motor-driven drive unit for the traction rod or driving rod nevertheless—upon application of the operating forces necessary for unlocking, but not counter to self-locking of the motor-driven drive unit—to be able to be actuated both in the opening direction for unlocking the locking device and in the closing direction for locking the locking device. The motor-driven drive unit is therefore then effective only in the opening direction, and in the closing direction is not coupled with the traction rod or driving rod.

When using an abovementioned pressure force transmission unit, it is more preferable for an initial movement of the traction rod or driving rod which is brought about by the actuating element to be accompanied by an idle stroke of the traction rod or driving rod which ends with a force uptake surface of the traction rod or driving rod, following on from the idle stroke, coming to lie against a force transmission surface of the motor-driven drive unit. In this manner, it is ensured that an initial movement of the traction rod or driving rod is in each case uninfluenced by self-locking of the motor-driven drive unit.

In a further preferred embodiment of the invention, provision is made for a first part of the sensor device to be formed by an additional element coupled for movement with the traction rod or driving rod, and for a second part of the sensor device to be arranged fixed to the door leaf. The use of an additional element has the advantage that it can be optimized with regard to particularly reliable and accurate detection of a movement of the additional element. Advantageously, the additional element has exclusively the abovementioned functions. This permits simple retrofitting of an additional element on existing installations.

It is possible for the additional element and the traction rod or driving rod to be connected together firmly and immovably relative to each other, for example by a positive and/or non-positive connection.

It is however preferred if the additional element and the traction rod or driving rod are coupled together such that the traction rod or driving rod upon movement in a first direction of movement drives the additional element, and that the additional element upon movement of the traction rod or driving rod is uncoupled from the traction rod or driving rod in a second direction of movement which is opposed to the first direction of movement. This can for example be achieved in that the additional element has an entraining portion which cooperates with only one limitation of a material recess or material cutout (in particular in the form of an elongate hole pocket or elongate hole aperture) formed in the traction rod or driving rod. Preferably the first direction of movement corresponds to unlocking of the locking device ("opening direction"), while the second direction of movement corresponds to locking of the locking device ("closing direction").

In the event that the additional element is not coupled with the traction rod or driving rod in both directions of movement thereof which are opposed to each other, it is advantageous to provide a restoring device which transfers the additional element out of a deflected position (into which the additional element has been brought by the traction rod or driving rod) back into a basic position. The restoring device may for example comprise a compression spring or tension spring.

Further, it is preferred if the second part of the sensor device is in the form of a coil or other suitably formed electrical conductor for generating an electrical, magnetic or electromagnetic field which changes dependent on the position of the additional element. In particular, precisely one and only one coil, or precisely one and only one suitably formed electrical conductor is provided. A coil or a suitably formed electrical conductor permits detection of a movement and/or ascertaining of a position of the additional element. As a result, a contactless sensor device can be provided which furthermore is not susceptible to disruption, for example due to dirt.

The additional element is preferably at least in portions, in particular as a whole, made from a ferromagnetic material, in particular iron. Such a material influences a magnetic field, the properties of which vary from the point of view of the second part of the sensor device upon displacement of the additional element, so that a movement of the additional element can be detected and/or a position of the additional element can be ascertained.

Independently of the use of an additional element, additionally or alternatively to the use of a coil or other suitably formed electrical conductor as the second part of the sensor device, other sensors may also be used, for example an optical sensor and/or a capacitive sensor which detects the change in an electrical field.

Likewise independently of the use of an additional element, in a departure from the feature named in claim 1 "sensor device for the contactless detection of a movement . . . " it is also possible to use a sensor device which is not contactless. Examples of such non-contactless sensor devices are named below for an electrical sensor and for a mechanical sensor.

Likewise, as the second part of the sensor device the use of an electrical sensor (for example a potentiometer) which detects the change in electrical parameters (for example resistance, voltage, current, eddy currents) is possible.

A mechanical sensor, for example a microswitch, can also be used as the second part of the sensor device.

Further, it is advantageous if the second part of the sensor device and the motor-driven drive are arranged in a common housing. This has the advantage that the motor-driven drive of an already-known system referred to first hereinbefore can be exchanged in a simple manner, without additional installation space having to be provided for the second part of the sensor device. This too makes simple retrofitting possible. In particular, it is preferred if the additional element and/or a restoring device described above is or are also arranged and/or mounted on or in the housing.

It is more preferable if the additional element has at least two material portions which are adjacent to each other, viewed in the direction of movement of the additional element, which portions have different dimensions from each other, viewed transversely to the direction of movement of the additional element. Therefore in each case more or less material is made available at the level of the material portions which are adjacent to each other, for example by varying the material thickness and/or material height of the material portions. In the event that the material portions are produced from an electrically and/or magnetically conductive material, the second part of the sensor device can detect a different electric, magnetic or electromagnetic field strength or field pattern for a smaller material portion compared with a field strength or a field pattern for a larger material portion.

A preferred embodiment of the invention provides for the additional element to have at least one land extending in the direction of movement of the additional element, which land has at least one margin which is stepped or arranged inclined relative to the direction of movement. Different positions of the additional element can be detected corresponding to the number of steps; in the case of a margin which is arranged inclined, even a number of positions of the additional element which corresponds to the resolution of the sensor device can be detected. In the simplest case, however, in each case a movement of the additional element can be detected.

It is likewise conceivable to detect the movement and/or the position of the additional element by its partial arrangement within an electrical, magnetic or electromagnetic field which is generated by a coil or by another suitably formed electrical conductor.

BRIEF DESCRIPTION OF THE SEVERAL VIEWS OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
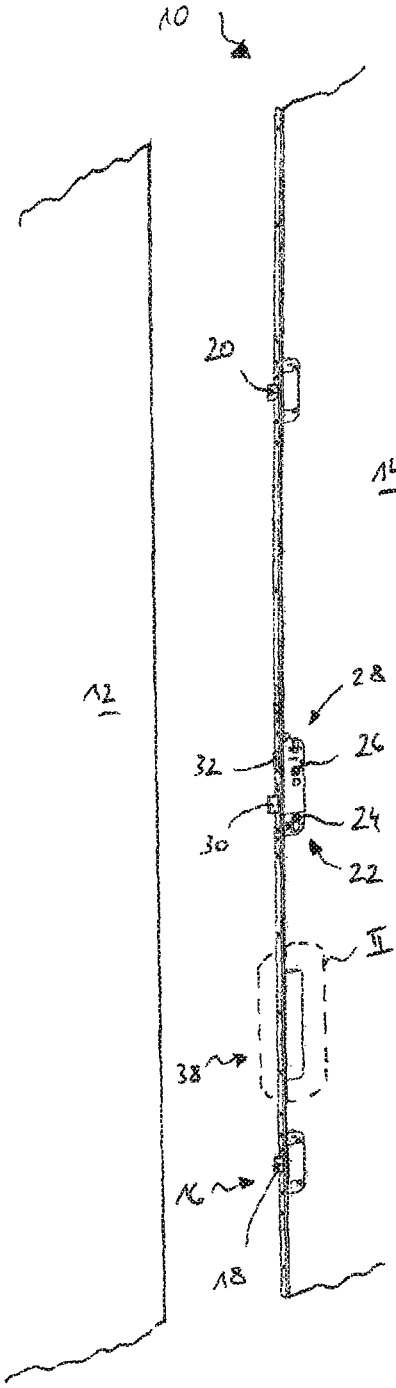
FIG. 1: a perspective view of an embodiment of a door arrangement.

An embodiment of a door arrangement is designated as a whole by the reference numeral 10 in the drawing. The door arrangement 10 comprises a door leaf 14 which can be moved, for example can be pivoted, relative to a frame. A locking device 16 is provided for locking the door leaf 14 to the frame 12, which device in the embodiment illustrated comprises two locking elements 18, 20. Actuation of the locking device 16 can take place by an actuating element 22, for example in the form of a closing cylinder 24. It is also possible for a door handle (not shown) to form an actuating element 22 which cooperates with a follower hub 26.

In the embodiment illustrated in the drawing, the actuating element 22 and/or the follower hub 26 is/are part of a lock case 28. It is possible for the lock case 28 to comprise a bolt 30 which is actuated directly by the actuating element 22, in particular in the form of the closing cylinder 24. The lock case 28 may, in addition or alternatively to a bolt 30 also comprise a latch bolt 32 which is actuated directly by an actuating element 22 in the form of a door handle using the follower hub 26.

In order to transmit a movement of the actuating element 22 to the locking elements 18, 20 a traction rod or driving rod 34 is provided which is overlaid by a faceplate 36 in a state mounted on the door leaf 14. In particular, the traction rod or driving rod 34 and the faceplate 36 extend along a vertically oriented side of the door leaf 14 which is remote from the hinge plate.

Figure 3:
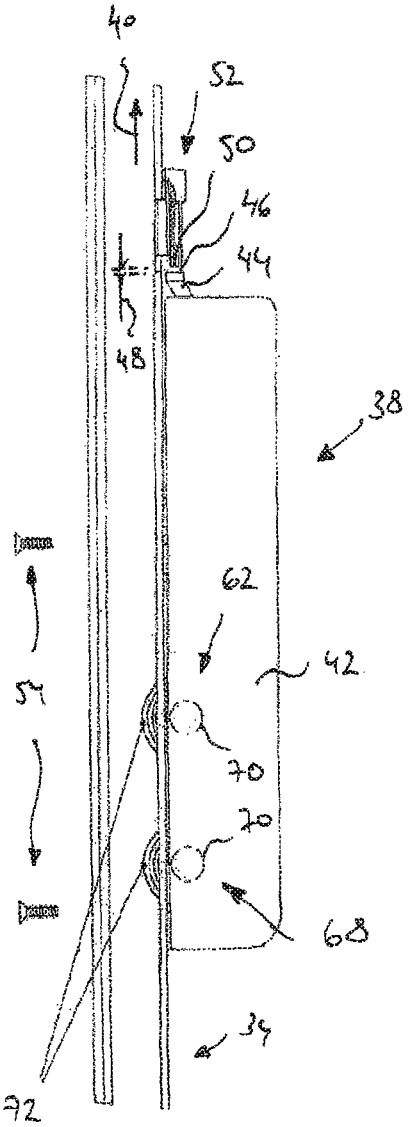
FIG. 3: the detail of FIG. 2 in a side view.

The door arrangement 10 further comprises a motor-driven drive unit which is designated as a whole by the reference numeral 38, by which the traction rod or driving rod 34 can be driven in particular directly, preferably exclusively in an opening direction 40 of the traction rod or driving rod 34 which is indicated in FIG. 3.

The motor-driven drive unit 38 comprises a motor arranged within a housing 42, by which motor a drive element 44 can be moved in the opening direction 40 of the traction rod or driving rod 34, and in the opposite direction thereto. The drive element 44 has a force transmission surface 46 which in a locked state of the locking device 16 is spaced apart by an idle stroke 48 from a force uptake surface 50 of a force uptake element 52 which is connected in positive and/or non-positive manner to the traction rod or driving rod 34.

The motor-driven drive unit 38 can be connected securely to the faceplate 36 by screws 54. In such case, it is preferable for the motor-driven drive unit 38 to comprise projections 56 which penetrate material apertures 58, in particular designed as elongate hole apertures, in the traction rod or driving rod 34. In such case, a front side of the projections 56 which faces the rear side of the faceplate 36 protrudes over a front side 60 of the traction rod or driving rod 34, so that the motor-driven drive unit 38 on one hand can be connected securely to the faceplate 36 and on the other hand permits free movement of the traction rod or driving rod 34 between the motor-driven drive unit 38 and the faceplate 36.

The door arrangement 10 further comprises a sensor device 62 for contactless detection of a movement of the traction rod or driving rod 34. The sensor device 62 comprises a first sensor part 64 which is formed by a portion 66 of the traction rod or driving rod 34.

A second part 68 of the sensor device 62 is arranged fixed to the door leaf, and therefore does not move jointly with the traction rod or driving rod 34. The second part 68 of the sensor device 62 is advantageously a coil 70 which generates a magnetic field 72 indicated in FIG. 3 when a current flows through it. An embodiment with two coils 70 is illustrated in the drawing; in another embodiment, merely one coil 70 is provided.

The magnetic field 72 of a or the coil 70 is changed by changing the position of the traction rod or driving rod 34, namely in that in the course of a movement of the traction rod or driving rod 34 the degree of coverage of the material aperture 58 which is in the form of an elongate hole relative to the coil 70 changes. The change in the magnetic field 72 brings about a change in a current flowing through the coil 70. This change is detected by a control unit and on exceeding a specifiable threshold value is used to activate the motor of the motor-driven drive unit 38.

Starting from a closed state of the door leaf 14, in which the door leaf 14 lies against the frame 12, and starting from a locked state of the locking device 16, in which the locking elements 18 and 20 lock the door leaf 14 to the frame 12, actuation of the actuating element 22 by an operator causes the traction rod or driving rod 34 to be moved starting from the state illustrated in FIG. 3. Due to the idle stroke 48, in such case the traction rod or driving rod 34 can be moved counter to the force of gravity (i.e. upwards); it is sufficient for the traction rod or driving rod 34, starting from its rest position, to be displaced at all and in so doing for the relative position of the material aperture 58 of the traction rod or driving rod 34 relative to the coil 70 to change. The change in the magnetic field 72 which is detectable thereby is used by the control unit of the motor-driven drive unit 38 to activate the motor.

Once the idle stroke 48 or part of the idle stroke 48 has been overcome and the force transmission surface 46 has subsequently come to lie against the force uptake surface 50, further driving of the drive element 44 brings about a movement of the traction rod or driving rod 34 in the opening direction 40. In this manner, the locking elements 16, 18 are unlocked in a manner known per se; in such case, operating forces on the actuating element 22 can be dispensed with entirely.

Once the locking device 16 has been released, the door leaf 14 can be opened.

The locking elements 18, 20 are for example spring-actuated latch bolts. Transferring of the traction rod or driving rod 34 counter to the opening direction 40 can take place by the spring actuation and/or by the traction rod or driving rod 34 being displaced downwards due to its own weight.

The housing 42 is provided spatially separated from the lock case 28. This simplifies retrofitting of an existing installation.

The magnetic field 72 is in particular an electromagnetic field.

Figure 2:
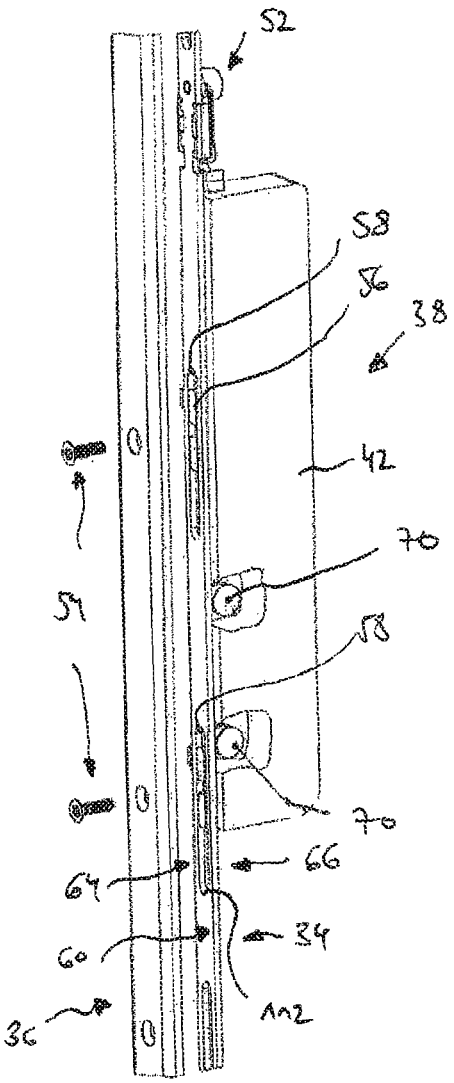
FIG. 2: a detail designated II in FIG. 1 in an enlarged exploded view.
Figure 4:
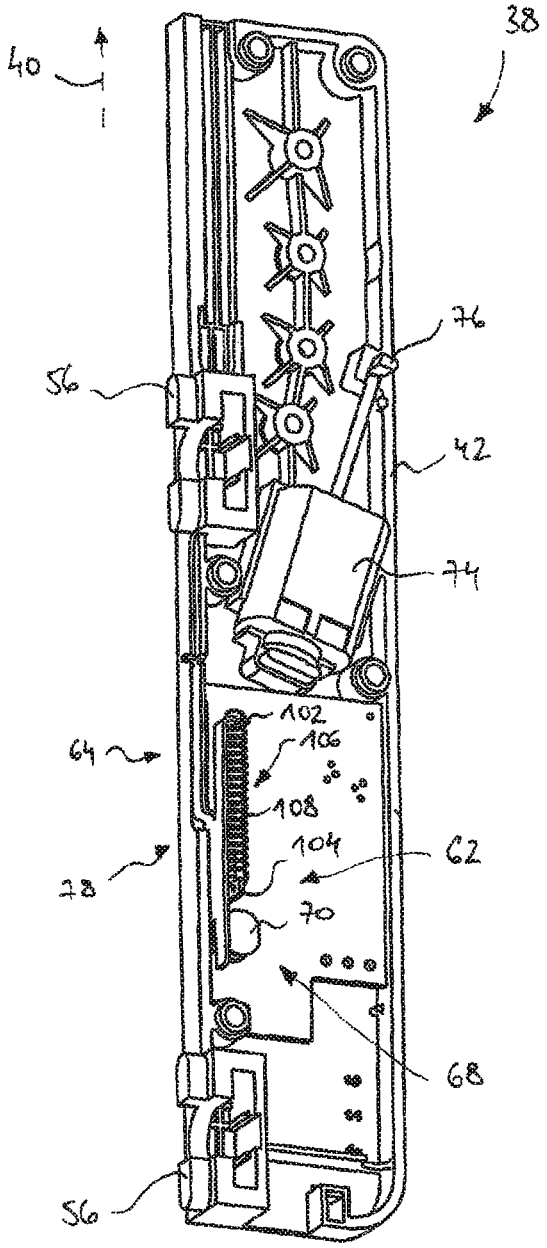
FIG. 4: a perspective view of a detail, which corresponds substantially to FIG. 2, of a further embodiment of a door arrangement, comprising an additional element.

FIG. 4 illustrates an assembly which can be used instead of the components illustrated in FIG. 2. In FIG. 4, however, the traction rod or driving rod 34 and the faceplate 36 are not shown in order to improve clarity. The mode of operation of the assembly according to FIG. 4 corresponds to the mode of operation described above with reference to FIGS. 1 to 3; identical reference numerals are used for identical or functionally identical components. The assembly according to FIG. 4 too comprises a housing 42 and a motor-driven drive 38. The drive 38 has a motor 74 which cooperates with a drive element 44 (cf. FIG. 2) via an actuator 76.

The assembly according to FIG. 4 comprises an additional element designated as a whole by the reference numeral 78, which is mounted displaceably on the housing 42. The additional element 78 forms the first part 64 of the sensor device 62. The second part 68 of the sensor device 62 is formed by a single coil 70.

The additional element 78 is in particular in the form of a metal part which is preferably produced by forming. The additional element 78 is produced in particular from a magnetic material.

Figure 5:
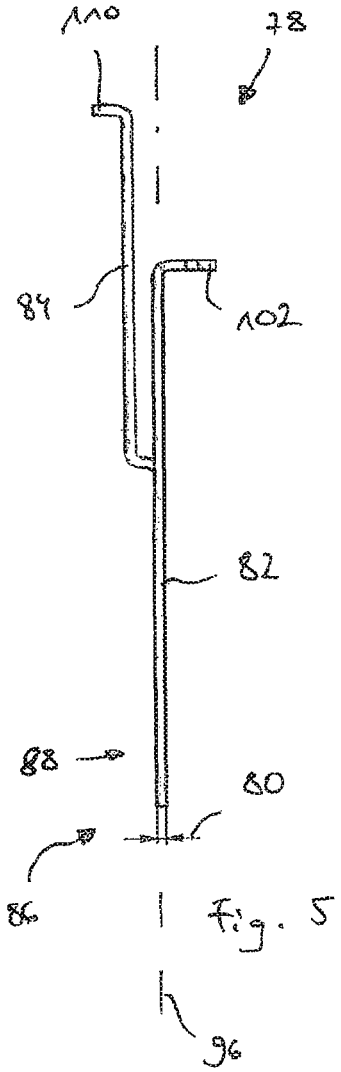
FIG. 5: a side view of the additional element.
Figure 6:
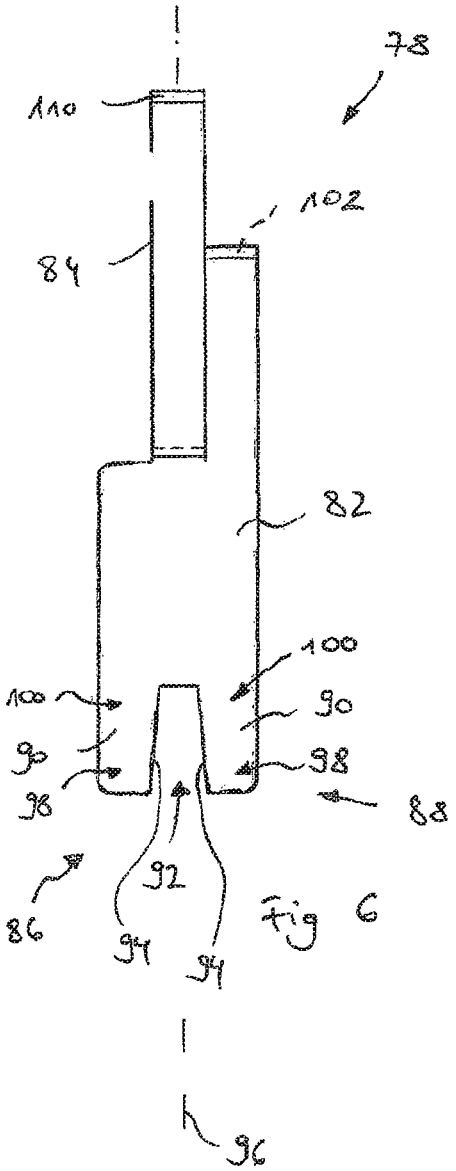
FIG. 6: a plan view of the additional element.

The additional element 78 has for example a material thickness 80 of approx. 0.5 mm to approx. 0.9 mm, in particular of approx. 0.7 mm (cf. FIGS. 5 and 6). The additional element 78 has a main plane 82 and an additional plane 84. The main plane 82 is arranged within the housing 42. The additional plane 84 runs parallel to the main plane 82 and offset in the direction of the faceplate 36.

The main plane 82 has a reference portion 88 at a free end 86. This portion comprises two lands 90, which jointly delimit a gap 92. The lands have margins 94 facing the gap 92. The margins 94 are oriented inclined relative to a main direction of extent 96 of the additional element 78, for example at an angle of approx. 5° to approx. 30°.

The main direction of extent 96 of the additional element 78 corresponds to an axis along which the additional element 78 can be moved relative to the housing 42. This axis runs parallel to an axis of movement of the traction rod or driving rod 34. The axis of movement 42 is defined by the opening direction 40 and a closing direction which is opposed thereto.

As a result of the margins 94 which are oriented inclined, the reference portion 88, viewed in the direction of movement of the additional element 78, has smaller material portions 98 and larger material portions 100 which are arranged adjacent to one another. These material portions preferably merge continuously into each other.

The main portion 82 of the additional element 78 has on its end remote from the reference portion 88 an angled portion 102, which together with a fixing device 104 (cf. FIG. 4) fixed to the housing serves to arrange a restoring device 106 in the form of a tension spring 108.

The additional portion 84 has a entraining portion 110 which faces away outwards relative to the housing 42, which portion cooperates with a (lower, in the drawing) limitation 112 of the material recess or material cutout 58, formed in the traction rod or driving rod 34, in the form of an elongate hole pocket or elongate hole aperture (cf. FIG. 2).

Upon a movement of the traction rod or driving rod 34 in the opening direction 40, the limitation 112 of the material recess or material cutout 58 entrains the additional element 78 in the identical direction, so that the reference portion 88 moves relative to the coil 70. This movement can be detected by the sensor device 62, in order subsequently to activate the motor-driven drive unit 38, so that a further movement of the traction rod or driving rod 34 is supported in a motor-driven manner.

During the course of the displacement of the additional element 78, the restoring device 106 is tensioned. If then the traction rod or driving rod is moved in a closing direction opposed to the opening direction 40, the limitation 112 of the material recess or material cutout 58 lifts off from the entraining portion 110. Returning of the additional element back into the non-deflected position takes place independently of the movement of the traction rod or driving rod 34 in that the energy stored in the restoring device 106 is released, in particular in that the tension spring 108 contracts.

Moreover, for example with respect to the fastening of the housing 42 to the faceplate 36, reference is made to the description relating to FIGS. 1 to 3 for the embodiment illustrated in FIGS. 4 to 6.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

The invention claimed is:

1. A door arrangement, comprising:

a frame;

a door leaf movable relative to the frame;

a locking device switchable between a locked state and an unlocked state, wherein, in the locked state, the locking device locks the door leaf to the frame by at least one locking element, and in the unlocked state, the locking device releases the door leaf relative to the frame, the locking device having a traction rod or driving rod arranged displaceably on the door leaf;

an actuating element actuatable for mechanically selecting the state of the locking device, the traction rod or driving rod being configured to transmit a movement of the actuating element to the at least one locking element;

a motor-driven drive unit for driving the traction rod or driving rod; and a sensor device including a first part and a second part, the first part of the sensor device comprising a material recess or material cutout in the traction rod or driving rod or an additional element coupled for movement with the traction rod or driving rod, and the second part of the sensor device being arranged fixed on the door leaf such that the sensor device is configured to detect a movement of the traction rod or driving rod, and wherein the motor-driven drive unit is activatable based on the movement of the traction rod or driving rod detected by the sensor device.

2. The door arrangement according to claim 1, wherein the first part of the sensor device comprises the material recess or material cutout in the traction rod or driving rod.

3. The door arrangement according to claim 2, wherein the material recess or material cutout in the traction rod or driving rod is in the form of an elongate hole pocket or elongate hole aperture.

4. The door arrangement according to claim 1, wherein the second part of the sensor device is a coil for generating a magnetic field which is changeable dependent on the position of the traction rod or driving rod.

5. The door arrangement according claim 1, wherein the second part of the sensor device is in the form of an optical sensor.

6. The door arrangement according to claim 1, wherein the second part of the sensor device and the motor-driven drive unit are arranged in a common housing.

7. The door arrangement according to claim 1, wherein the locking device comprises a plurality of locking elements which cooperate with the traction rod or driving rod.

8. The door arrangement according to claim 1, wherein the activation of the motor-driven drive unit transfers the locking device out of the locked state into the unlocked state.

9. The door arrangement according to claim 1, wherein the motor-driven drive unit is configured to transfer the traction rod or driving rod by a pressure force transmission unit in an opening direction out of the locked state into the unlocked state, and in the motor-driven drive unit is uncoupled from the traction rod or driving rod in a closing direction which is opposite the opening direction.

10. The door arrangement according to claim 9, wherein an initial movement of the traction rod or driving rod which is brought about by the actuation of the actuating element is accompanied by an idle stroke of the traction rod or driving rod which ends with a force uptake surface of the traction rod or driving rod, following on from the idle stroke, coming to lie against a force transmission surface of the motor-driven drive unit.

11. The door arrangement according to claim 1, wherein a first part of the sensor device is formed by the additional element coupled for movement with the traction rod or driving rod.

12. The door arrangement according to claim 11, wherein the second part of the sensor device is one or more of an electrical conductor for generating an electrical, magnetic or electromagnetic field which changes dependent on the position of the additional element and an optical, capacitive, electrical or mechanical sensor.

13. The door arrangement according to claim 11, wherein the second part of the sensor device and the motor-driven drive unit are arranged in a common housing.

14. The door arrangement according claim 11, wherein the additional element has at least two material portions which are adjacent to each other, viewed in the direction of movement of the additional element, which portions have different dimensions from each other, viewed transversely to the direction of movement of the additional element.

15. The door arrangement according to claim 11, wherein the additional element has at least one land extending in the direction of movement of the additional element, the at least one land having at least one margin which is stepped or arranged inclined relative to the direction of movement.

16. The door arrangement according to claim 1, wherein the traction rod or driving rod extends vertically between the actuating element and the at least one locking element along a vertically oriented side of the door leaf at which the door leaf is lockable to the frame.

17. A locking arrangement for a door, the locking arrangement comprising:

a locking device including a traction rod or driving rod, the locking device being configured to be arranged on a door leaf such that the door leaf is lockable to a frame by at least one locking element of the locking device;

an actuating element actuatable for mechanically selecting the state of the locking device;

a motor-driven drive unit for driving the traction rod or driving rod; and a sensor device including a first part and a second part, the first part of the sensor device comprising a material recess or material cutout in the traction rod or driving rod or an additional element coupled for movement with the traction rod or driving rod, and the second part of the sensor device being arrangable fixed on the door leaf such that the sensor device is configured to detect a movement of the traction rod or driving rod, wherein the traction rod or driving rod, in an installed state of the locking arrangement, is arranged displaceably on the door leaf and configured to transmit a movement of the actuating element to the at least one locking element, and wherein the motor-driven drive unit is activatable based on the movement of the traction rod or driving rod detected by the sensor device.

18. The locking arrangement according to claim 17, wherein, in the installed state of the locking arrangement, the traction rod or driving rod extends vertically between the actuating element and the at least one locking element along a vertically oriented side of the door leaf at which the door leaf is lockable to the frame.

19. The locking arrangement according to claim 17, wherein the first part of the sensor device comprises the material recess or material cutout in the traction rod or driving rod.

20. The locking arrangement according to claim 19, wherein the material recess or material cutout in the traction rod or driving rod is in the form of an elongate hole pocket or elongate hole aperture.

* * * * *